US007594658B2

(12) United States Patent
Mutschall et al.

(10) Patent No.: US 7,594,658 B2
(45) Date of Patent: Sep. 29, 2009

(54) DEVICE FOR CONVEYING A SHEET THROUGH A TYPOGRAPHIC MACHINE

(75) Inventors: Stephan Mutschall, Östringen (DE); Andreas Detloff, Walldorf (DE); Paul Nicola, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/943,615

(22) Filed: Nov. 21, 2007

(65) Prior Publication Data

US 2008/0136095 A1 Jun. 12, 2008

(30) Foreign Application Priority Data

Nov. 21, 2006 (DE) ..... 10 2006 054 825

(51) Int. Cl.
*B65H 5/02* (2006.01)

(52) U.S. Cl. ..... 271/277; 271/314; 271/275; 271/82

(58) Field of Classification Search ..... 271/275, 271/276, 277, 304, 198, 82, 314, 69; 101/230, 101/232, 409

See application file for complete search history.

(56) References Cited

U.S. PATENT DOCUMENTS 5,421,257 A * 6/1995 Okuda et al. ..... 101/137
5,431,386 A 7/1995 Blaser
6,578,846 B2 6/2003 Maul et al.
7,234,395 B2 6/2007 Förch et al.
7,448,625 B2 * 11/2008 Forch et al. ..... 271/277

FOREIGN PATENT DOCUMENTS

DE 4218421 A1 12/1993
DE 10014417 A1 9/2001
DE 10349668 A1 5/2004
DE 10358171 A1 7/2005

OTHER PUBLICATIONS

German Search Report, dated May 2, 2007.

* cited by examiner

*Primary Examiner*—Kaitlin S Joerger
(74) *Attorney, Agent, or Firm*—Laurence A. Greenberg; Werner H. Stemer; Ralph E. Locher

(57) ABSTRACT

A device for conveying a sheet through a typographic or printing technology machine reliably transfers a sheet from a cylinder to a trailing-edge gripper system and includes a chain conveyor, grippers for holding and taking over the leading margin of the sheet from a cylinder and grippers fixed to endless chains for holding the trailing, rear margin of the sheet. When the grippers for the trailing margin pass the cylinder, the grippers are guided in a closed state along a path outside a revolution contour of a support surface and, having passed the cylinder, the grippers are guided in an open state along a path to a radial level of the rear margin held in auxiliary grippers.

2 Claims, 5 Drawing Sheets

DEVICE FOR CONVEYING A SHEET THROUGH A TYPOGRAPHIC MACHINE

CROSS-REFERENCE TO RELATED APPLICATION

This application claims the priority, under 35 U.S.C. § 119, of German Patent Application DE 10 2006 054 825.6, filed Nov. 21, 2006; the prior application is herewith incorporated by reference in its entirety.

BACKGROUND OF THE INVENTION

Field of the Invention

The invention relates to a device for conveying a sheet through a typographic or printing technology machine. The device includes a rotatable cylinder having at least one gap in which grippers for holding the leading, front margin of the sheet are disposed and having at least one carrying element that forms a cylinder-jacket-shaped sheet support surface. A chain conveyor has grippers that are fastened to endless chains placed over rotatable sprockets and are provided for holding and taking over a leading margin of the sheet from the cylinder and for holding the trailing, rear margin of the sheet. Coaxially revolving support elements for the sheet are disposed between the sprockets associated with the cylinder and are in rolling contact with the sheet resting on the support surface. Coaxially revolving auxiliary grippers provided for holding the trailing margin of the sheet are disposed between the sprockets associated with the cylinder. An actuating device opens and closes the grippers and a drive is provided for the cylinder and the sprockets.

German Published, Non-Prosecuted Patent Application DE 100 14 417 A1, corresponding to U.S. Pat. No. 6,578,846, describes a device for transporting a sheet in a rotary printing press. In the device described therein, a sheet is transferred from a cylinder to a chain gripper system. Grippers hold the leading and trailing edges of the sheet in the chain gripper system. The trailing-edge grippers take over the sheet in the outlet wedge between the support surfaces revolving with sprockets and the cylinder jacket surface. The sheet is held by suction grippers that likewise revolve with the sprockets, until the sheet is transferred to the trailing-edge grippers. Gripper seats of the trailing-edge grippers are located above a path that is described by the sheet held on the jacket surface of the cylinder. Appropriate cutouts are provided in the jacket surface of the cylinder to allow the trailing-edge grippers to pass the jacket surface of the cylinder without collision. That complicates the manufacturing process of the cylinders.

In a device described in German Published, Non-Prosecuted Patent Application DE 103 58 171 A1, corresponding to U.S. Pat. No. 7,234,395, two revolving chain gripper systems are provided for conveying a sheet at its leading and trailing edges from an impression cylinder to a stack. The chain gripper systems carry gripper bars with a plurality of grippers for the leading and trailing edges. A distance between the gripper bars for the trailing edge and the gripper bars for the leading edge is adjustable to accommodate different sheet lengths. During sheet transfer, the leading-edge grippers dip into a respective gap of the impression cylinder. As the trailing-edge grippers pass the closed jacket surface of the impression cylinder, the trailing-edge grippers are open to such an extent that they do not collide with the jacket surface. A cam gearing and a lever gearing are provided to open the trailing-edge grippers. High torques are transmitted to achieve an opening angle of approximately 90 degrees. The high torques cause a high degree of wear at the gearing elements and thus limit the useful life and component strength of the gear mechanisms.

BRIEF SUMMARY OF THE INVENTION

It is accordingly an object of the invention to provide a device for conveying a sheet through a typographic machine, which overcomes the hereinafore-mentioned disadvantages of the heretofore-known devices of this general type and in which a sheet is transferred from a cylinder to a trailing-edge gripper system with increased reliability.

With the foregoing and other objects in view there is provided, in accordance with the invention, a device for conveying a sheet through a typographic machine. The device comprises a rotatable cylinder having at least one gap formed therein, grippers disposed in the at least one gap for holding the leading, front margin of the sheet, and at least one carrying element forming a cylinder-jacket-shaped sheet support surface having a revolution contour. A chain conveyor has rotatable sprockets, endless chains placed over the rotatable sprockets, and grippers fastened to the endless chains for holding and taking over the leading margin of the sheet from the cylinder and for holding the trailing, rear margin of the sheet. Coaxially revolving support elements for the sheet are disposed between the sprockets associated with the cylinder and are in rolling contact with the sheet resting on the support surface. Coaxially revolving auxiliary grippers are disposed between the sprockets associated with the cylinder, for holding the trailing margin of the sheet. An actuating device is provided for opening and closing the grippers. A drive is provided for the cylinder and the sprockets. The grippers for the trailing margin are guided in a closed state along a path outside the revolution contour of the support surface, while passing the cylinder. The grippers for the trailing margin are guided in an opened state along the path to a radial level of the trailing margin held in the auxiliary grippers, after passing the cylinder.

Therefore, in accordance with the invention, trailing-edge grippers disposed on a chain gripper system are in a closed state when they are guided past a cylinder having at least one closed or continuous cylinder-jacket-shaped sheet support surface. As the trailing-edge grippers pass the cylinder, the trailing-edge grippers are guided on a path that is outside the revolution contour of the sheet support surface, so that a collision between the trailing-edge grippers and cylinder components that form the sheet support surface is avoided. Once the trailing-edge grippers have passed the cylinder, they are opened and moved radially outward so that a trailing sheet margin temporarily held by auxiliary grippers is captured by the trailing-edge grippers. After closing, the trailing-edge grippers substantially follow the path of the leading-edge grippers. The trailing-edge grippers only open as far as necessary for the trailing sheet margin to be inserted. The torques required for opening and closing the trailing-edge grippers are low so that only a low degree of wear occurs at the components of the gear mechanisms for opening and closing.

Other features which are considered as characteristic for the invention are set forth in the appended claims.

Although the invention is illustrated and described herein as embodied in a device for conveying a sheet through a typographic machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
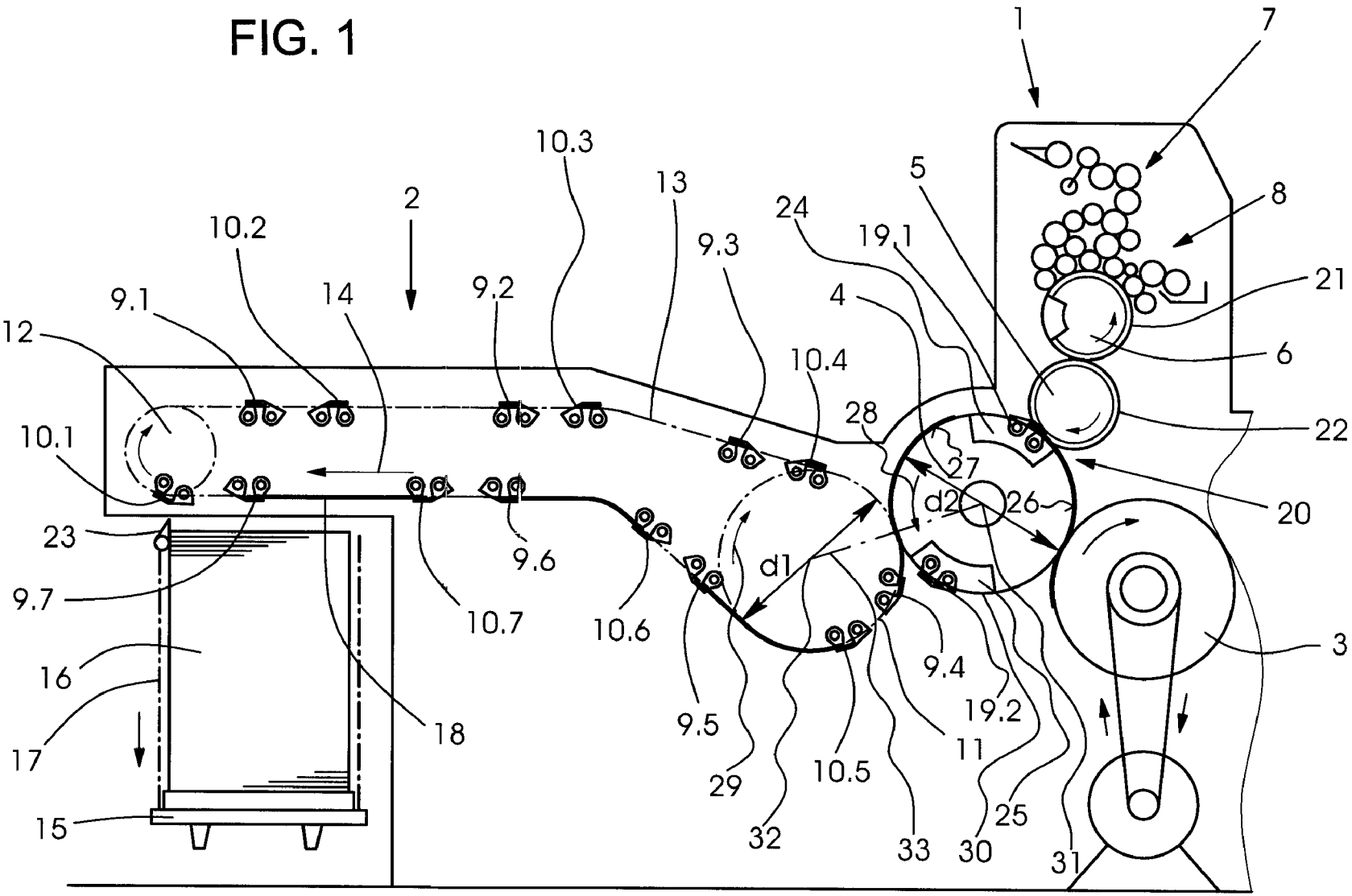
FIG. 1 is a diagrammatic, longitudinal-sectional view of a delivery of a printing press including chain gripper systems.

Referring now to the figures of the drawings in detail and first, particularly, to FIG. 1 thereof, there is seen the last printing unit 1 of a sheet-fed printing press with a downstream delivery 2. The printing unit 1 includes a sheet transport drum 3, an impression cylinder 4, a transfer cylinder 5 and a plate cylinder 6. Rollers of an inking unit 7 and of a dampening unit 8 are associated with the plate cylinder 6. The delivery 2 includes chain gripper systems with leading-edge gripper systems 9.1 to 9.7 and trailing-edge gripper systems 10.1 to 10.7, which are mounted on gripper bars. The gripper bars are connected by endless chains guided over sprockets 11, 12 and chain paths 13. At the end of lower strands or runs of the chain paths 13, as viewed in a conveying direction 14, there is a stack table 15 that carries a stack 16. The stack table 16 can be lowered through the use of a chain transmission 17 in a manner corresponding to the progress of the production.

The sheet transport drum 3 conveys sheets 18 from the previous printing unit to the impression cylinder 4. The sheets 18 are held on the impression cylinder 4 in grippers 19.1, 19.2 and guided through a printing nip 20 formed between the transfer cylinder 5 and the impression cylinder 4. The dampening unit 8 and the inking unit 7 are used to ink a printing plate 21 provided on the plate cylinder 6 in accordance with an image to be printed. The transfer cylinder 5 has a rubber-elastic cover 22, which transfers the printing ink to the sheet 18 in the printing nip 21. In the delivery 2, the leading edges of the sheets 18 are gripped by the leading-edge gripper systems 9 while the trailing margins of the sheets 18 are held by the trailing-edge gripper systems 10. The gripper systems 9, 10 open just before the stack 16 to release a sheet 18 onto the stack 16. A leading-edge stop 23 limits the movement of the released sheet 18 in the conveying direction 14.

The diameter of the impression cylinder 4 is twice the diameter of the plate cylinder 6. The impression cylinder 4 has two channels or gaps 24, 25 in which the leading-edge gripper systems 19.1, 19.2 are disposed on gripper bars. The gaps 24, 25 divide the cylinder-jacket-shaped surface of the impression cylinder 4 into two sheet support surfaces 26, 27. The length of the sheet support surfaces 26, 27 in the circumferential direction 28 of the impression cylinder 4 corresponds to the maximum length of a sheet 18 to be conveyed. The impression cylinder 4 and the sprockets 11 are driven in synchronism in the directions of the arrows 28, 29. A pitch diameter d1 of the sprockets 11 of the chain gripper system for the leading-edge gripper systems 9.1-9.7 and a diameter d2 of a revolution contour of the sheet support surfaces 26, 27, are approximately equal. A connecting line between axes 31, 32 of the impression cylinder 4 and the sprockets 11 forms a line of transfer 33.

When a sheet 18 is transferred from a gripper system 19.1, 19.2 to a gripper system 9.1-9.7, the gripper closing lines in the revolution contour 30 are parallel with the axes 31, 32 and perpendicular to the line of transfer 33. As the leading-edge gripper systems 9.1-9.7 take over the leading margin of the sheet 18, they dip into the respective gap 24, 25.

The transfer of a trailing margin of a sheet 18 to a gripper system 10.1-10.7 will be explained below with reference to FIGS. 2-5: The chains of the trailing-edge gripper systems 10.1-10.7 wrap around a sprocket that has a diameter d3<d1 coaxial with the axis 32. A gripper bar 34 with a gripper finger 35 and a gripper pad 36 of the trailing-edge gripper system 10.1-10.7 is shown. The gripper finger 35 is disposed on a gripper shaft and is pivotable about an axis 37. The gripper bar 34 is mounted in joints 38, 39 on the chains of the trailing-edge gripper system 10.1-10.7. Auxiliary suction grippers 40 and lateral-edge support elements 41 revolve around the axis 32 in synchronism with the sprockets 11.

Figure 2:
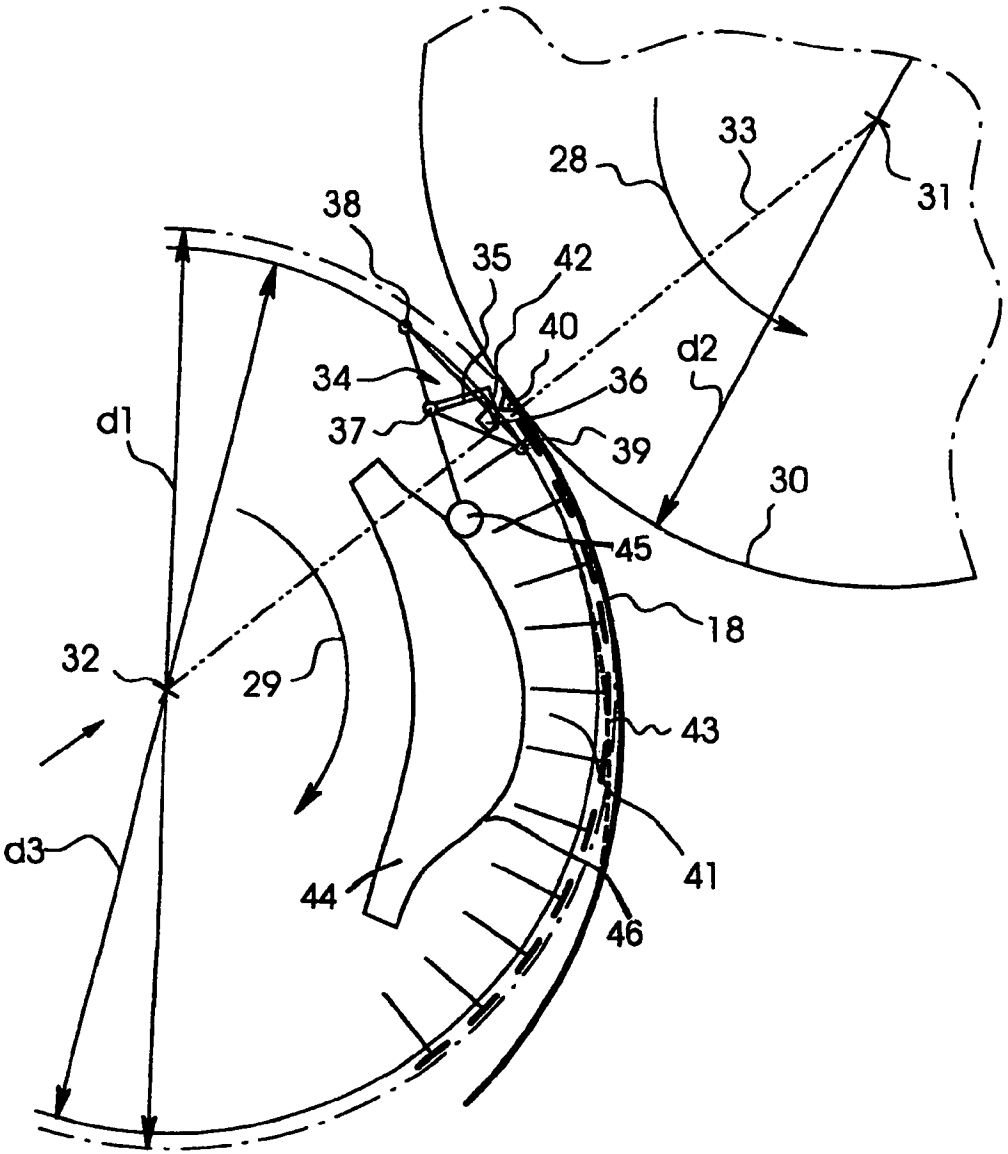
FIGS. 2-5 are fragmentary, side-elevational views of different phases of a transfer of a sheet at a trailing sheet margin.

In FIG. 2, the auxiliary suction grippers 40 and the gripper bar 34 are located just before the line of transfer 33 as viewed in the revolving direction 29. The auxiliary suction grippers 40 revolve on the diameter d1. In the rotational position shown in FIG. 2, the leading sheet margin is held in a leading-edge gripper system 9.1-9.7, while the trailing sheet margin of the sheet 18 is located in the line of transfer 33. In this rotational position, the auxiliary suction grippers 40 are activated to hold the trailing sheet margin. The grippers of the trailing-edge gripper bar 34 are in a closed state wherein the gripper fingers 35 rest on the gripper pads 36. The revolution contour of the gripper fingers 35 is below the diameter d1. As the gripper bar 34 moves onward, the closed gripper fingers 35 are guided past the respective sheet support surface 26, 27 of the impression cylinder 4. A stationary cam body 44 defines a guide path 46 for a radial movement of the grinner bar 34. A cam roller 45 is connected to the grinner bar 34 and is in rolling contact with the stationary cam body 44.

Figure 3:
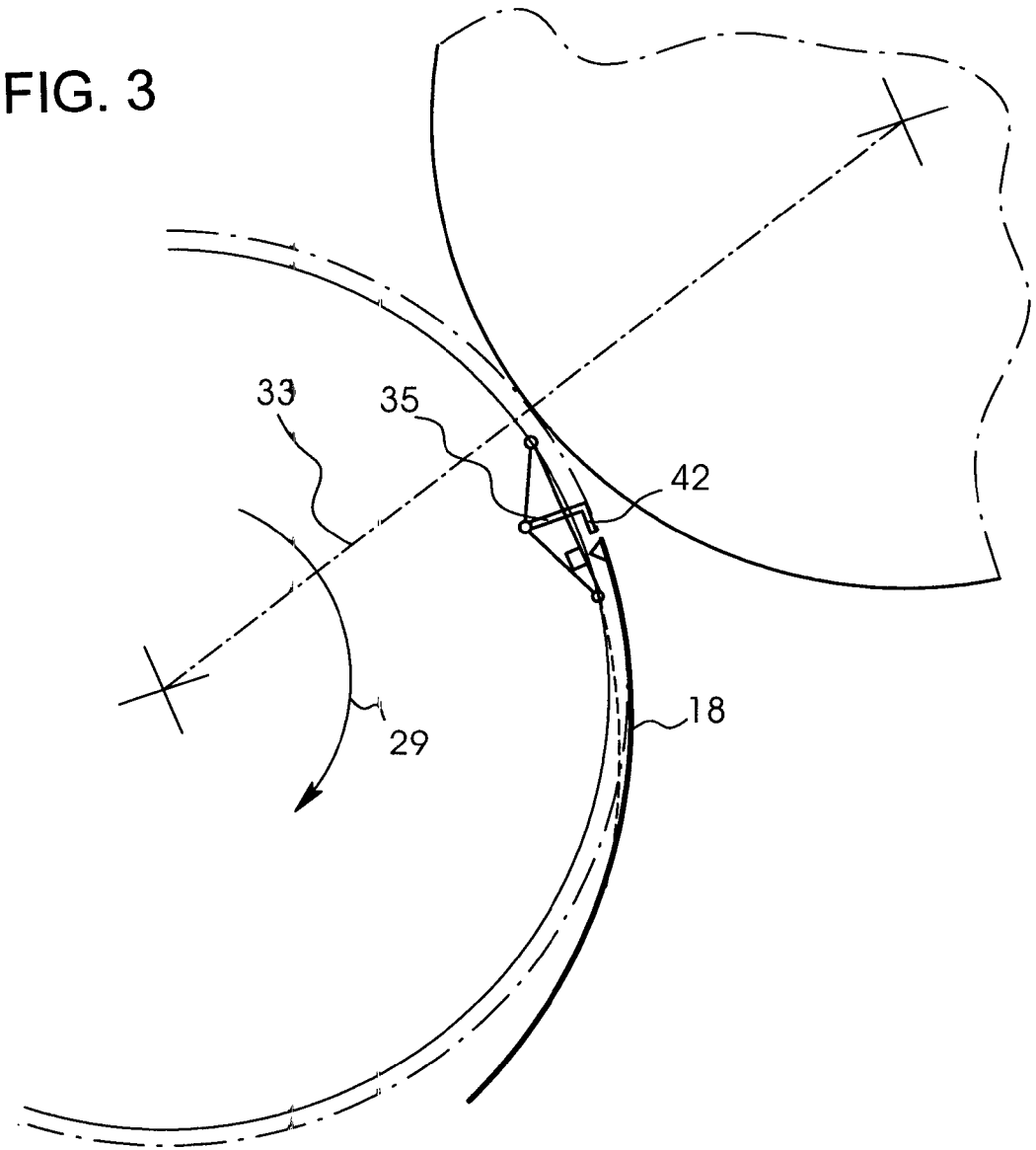

As is shown in FIG. 3, the gripper fingers 35 open in the region of the angle of rotation that is beyond the line of transfer 33. As they open, the gripper fingers 35 are moved radially outward and pivoted backward as viewed in the circumferential direction 29. Gripper tips 42 are downstream of the trailing edge of the sheet as viewed in the circumferential direction 29.

Figure 4:
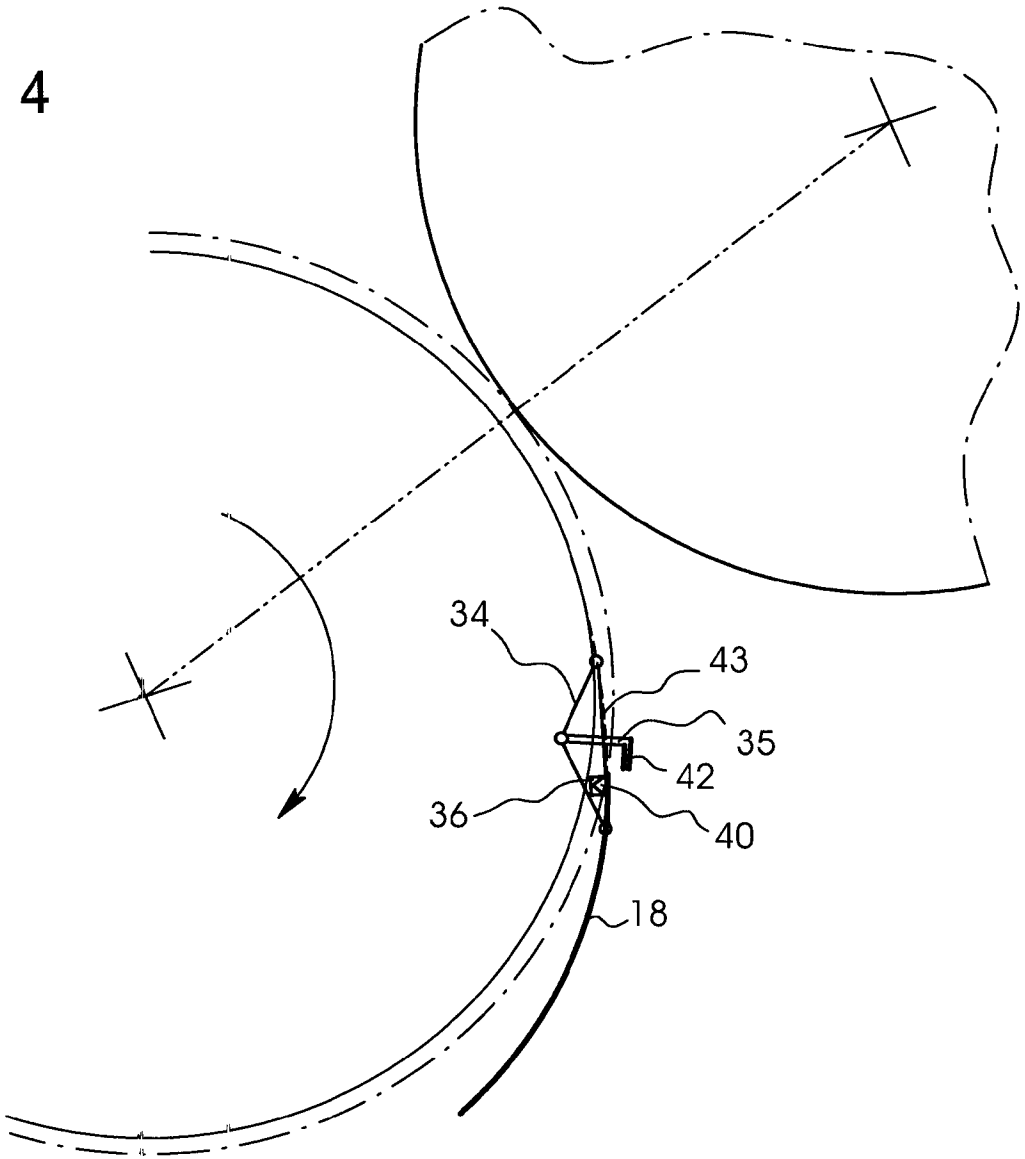

As the gripper bar 34 moves onward, it is moved in a chain guide on a path 43 that guides the gripper pads 36 and gripper fingers 35 radially outward as is shown in FIG. 4. The gripper pads 36 reach the radial level of the auxiliary suction grippers 40, and the gripper tips 42 of the gripper fingers 35 move in above the trailing margin of the sheet 18.

Figure 5:
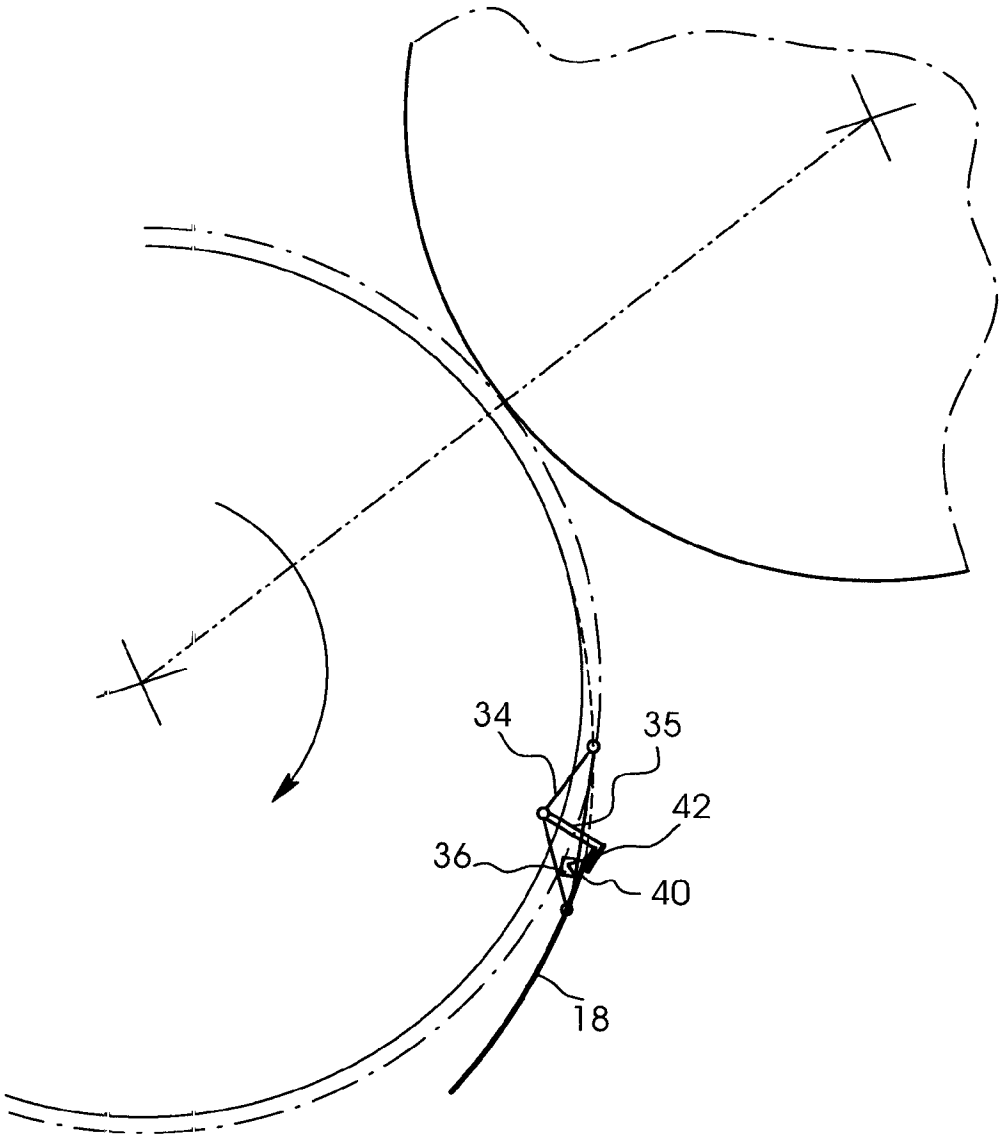

As the gripper bar 34 moves onward into the rotational position shown in FIG. 5, the gripper fingers 35 close and the auxiliary suction grippers 40 are deactivated. From then on, the trailing sheet margin of the sheet 18 is held between the gripper tips 42 and the gripper pads 36 and is conveyed above the stack 16.

The invention claimed is:

1. A device for conveying a sheet through a typographic machine, the device comprising:

a rotatable cylinder having at least one gap formed therein, grippers disposed in said at least one gap for holding the leading, front margin of the sheet, and at least one carrying element forming a cylinder-jacket-shaped sheet support surface, said support surface having a revolution contour;

a chain conveyor having rotatable sprockets, endless chains placed over said rotatable sprockets, and grippers fastened to said endless chains for holding and taking over the leading margin of the sheet from said cylinder and for holding the trailing, rear margin of the sheet;

coaxially revolving support elements for the sheet, said support elements being disposed between said sprockets associated with said cylinder and being in rolling contact with the sheet resting on said support surface;

coaxially revolving auxiliary grippers disposed between said sprockets associated with said cylinder, for holding the trailing margin of the sheet;

an actuating device for opening and closing said grippers; and a drive for said cylinder and said sprockets;

said grippers for the trailing margin being guided in a closed state along a path outside said revolution contour of said support surface, while passing said cylinder; and said grippers for the trailing margin being guided in an opened state along said path to a radial level of the trailing margin held in said auxiliary grippers, after passing said cylinder.

2. The device according to claim 1, which further comprises:

a gripper bar;

a stationary cam body defining a guide path for a radial movement of said gripper bar;

a cam roller being connected to said gripper bar and in rolling contact with said stationary cam body; and said grippers for the trailing margin being disposed on said gripper bar.

* * * * *